US006765168B2

(12) United States Patent
Takebuchi et al.

(10) Patent No.: US 6,765,168 B2
(45) Date of Patent: Jul. 20, 2004

(54) ELECTRODE OF VACUUM CIRCUIT BREAKER, AND METHOD OF PRODUCING ELECTRODE OF VACUUM CIRCUIT BREAKER

(75) Inventors: Hidemitsu Takebuchi, Chiba (JP); Yoshihiko Matsui, Shizuoka (JP); Akira Nishijima, Shizuoka (JP); Yoshihiro Fukatsu, Shizuoka (JP)

(73) Assignee: Kabushiki Kaisha Meidensha, Tokyo (JP)

( * ) Notice: Subject to any disclaimer, the term of this patent is extended or adjusted under 35 U.S.C. 154(b) by 7 days.

(21) Appl. No.: 10/083,500

(22) Filed: Feb. 27, 2002

(65) Prior Publication Data

US 2002/0166841 A1 Nov. 14, 2002

(30) Foreign Application Priority Data

May 9, 2001 (JP) ..... 2001-138213

(51) Int. Cl.[7] ..... H01H 33/66
(52) U.S. Cl. ..... 218/123; 218/118; 218/128
(58) Field of Search ..... 218/118, 123–128

(56) References Cited

U.S. PATENT DOCUMENTS 4,620,074 A * 10/1986 Paul et al. ..... 218/128
4,704,506 A 11/1987 Kurosawa et al.
5,055,639 A * 10/1991 Schels et al. ..... 218/129
6,072,141 A * 6/2000 Slamecka ..... 218/127

FOREIGN PATENT DOCUMENTS

DE 41 14 636 9/1991
EP 0 615 263 9/1994

* cited by examiner

*Primary Examiner*—Lincoln Donovan
(74) *Attorney, Agent, or Firm*—Foley & Lardner LLP

(57) ABSTRACT

An electrode of a vacuum circuit breaker has a cup member and a contact. The cup member has an opening and a periphery which is formed with a slit so as to form a coil section. An electric current flows in the coil section so as to generate a longitudinal magnetic field in a direction along an axis of the cup member. The slit is bent and continuously extends on the periphery from a first end of the cup member to a second end of the cup member opposite to the first end of the cup member. The contact is shaped into a plate, and seals the opening of the cup member.

6 Claims, 8 Drawing Sheets

ELECTRODE OF VACUUM CIRCUIT BREAKER, AND METHOD OF PRODUCING ELECTRODE OF VACUUM CIRCUIT BREAKER

BACKGROUND OF THE INVENTION

1. Field of the Invention

The present invention relates to an electrode of a vacuum circuit breaker, and a method of producing the electrode of the vacuum circuit breaker. Especially, the present invention is applicable to an electrode which is shaped substantially into a cup and has a longitudinal magnetic field.

2. Description of the Related Art

An electric arc occurs between electrodes during circuit break. For improving breaking capability of a vacuum circuit breaker, an entire surface of each of the electrodes is subjected to a damage caused by the electric arc. In other words, concentration of the electric arc in one spot on the surface should be prevented. For receiving the damage (caused by the electric arc) on the entire surface, a constitution having a longitudinal magnetic-field electrode (axial magnetic-field electrode) is adopted, as is seen in FIG. 7 and FIG. 8.

As is seen in FIG. 7, there is provided a constitution of the longitudinal magnetic-field electrode having an electrode 01 (immovable side) and an electrode 02(movable side). The electrode 01 is constituted of a contact 01*a*, and a coil electrode 01*b* which is disposed on a side opposite to a contact face of the contact 01*a*. The movable electrode 02 is constituted of a contact 02*a*, and a coil electrode 02*b* which is disposed on a side opposite to a contact face of the contact 02*a*. Each of the coil electrode 01*b* and the coil electrode 02*b* has an arm extending radially from an axial center thereof. The arm has a peak end which is fitted with a coil extending circumferentially. With electric current flowing in the coil circumferentially, a magnetic field is caused in parallel with the electric arc (longitudinal magnetic field). The longitudinal magnetic field applied to the electric arc prevents radial diffusion of charged particles, to thereby stabilize the electric arc. The thus stabilized electric arc reduces loss, to thereby control increase in temperature of the electrode. With this, the breaking capability of the vacuum circuit breaker is improved.

The longitudinal magnetic-field electrode is, however, complicated in overall constitution. Moreover, each component part used for the longitudinal magnetic-field electrode is also complicated in constitution (unit constitution). Therefore, producing the longitudinal magnetic-field electrode is costly. For reducing the production cost, the longitudinal magnetic-field electrode should be simple in constitution and reduced in number of component parts.

As is seen in FIG. 8, there is provided a constitution of the longitudinal magnetic-field electrode having an electrode 011 and an electrode 012 opposed to the electrode 011. On a periphery of a cup member of the electrode 011, a slit 011*a* (inclined) is formed to provide a coil section 011*b*. On a periphery of a cup member of the electrode 012, a slit 012*a* (inclined) is formed to provide a coil section 012*b*. Moreover, the cup member of the electrode 011 has an opening which is sealed with a contact 011*c*, while the cup member of the electrode 012 has an opening which is sealed with a contact 012*c*.

As is seen in FIG. 9 (cross section of the longitudinal magnetic-field electrode in FIG. 8), the electrode 011 has a reinforcing pipe 011*d* in addition to the cup member (coil section 011*b*) and the contact 011*c*, while the electrode 012 has a reinforcing pipe 012*d* in addition to the cup member (coil section 012*b*) and the contact 012*c*. Each of the reinforcing pipe 011*d* and the reinforcing pipe 012*d* is mated in a hollow section of the cup member, so as to reinforce stability (of the longitudinal magnetic-field electrode) against mechanical impact caused by a contacting of the contact 011*c* on the contact 012*c* when the vacuum circuit breaker is inputted.

The longitudinal magnetic-field electrode (having the cup member) in FIG. 8 and FIG. 9 is smaller in number of component parts than the longitudinal magnetic-field electrode in FIG. 7. However, it is necessary for the cup member in FIG. 8 and FIG. 9 to be formed with the slit 011*a* and the slit 012*a*, so as to provide, respectively, the coil section 011*b* and the coil section 012*b*.

Therefore, as is seen in FIG. 10, there is provided a turn blade 013 shaped substantially into a disk. For machining the cup member (copper) so as to form the slit 011*a* and the slit 012*a*, the turn blade 013 is turned with a predetermined inclination angle relative to the cup member. Conventionally, this is a general machining (slitting) method.

As shown in FIG. 10, machining with the turn blade 013 has advantages such as easiness and low cost. The machining with the turn blade 013 has, however, difficulty in securing a long circumferential dimension of the slit 011*a* and the slit 012*a*. Smaller inclination angle of the turn blade 013 (relative to the cup member) makes the machining more difficult.

The longitudinal magnetic field between the electrode 011 and the electrode 012 is proportional to a product of electric current (flowing in each of the coil section 011*b* and the coil section 012*b*) and a turning angle. The product is defined as "ampere·turn=i·n". In other words, the circumferential length of each of the slit 011*a* and the slit 012*a* is an important determinant of the turning angle (number of turns n) of the electric current. The longer the circumferential length is, the higher the longitudinal magnetic field is.

The above summarizes that the electrode 011 (having the cup member) and the electrode 012 (having the cup member) constituting the longitudinal magnetic field according to the related art have a difficulty in obtaining strong magnetic field, and therefore are not sufficient for the vacuum circuit breaker that requires capability of breaking a high voltage and a large electric current.

Moreover, the vacuum circuit breaker with the electrode 011 and the electrode 012 according to the above related art is disadvantageous in terms of strength for the following causes: The smaller the inclination angle of slitting the slit 011*a* and the slit 012*a* is, the more acute the junction A (see FIG. 8) is. The acuteness of the junction A (coil section 011*b* with the contact 011*c*, and the coil section 012*b* with the contact 012*c*) causes stress concentration. Thereby, the junction A is likely to peel after repeated operations (opening and closing) of the electrode 011 and the electrode 012 of the vacuum circuit breaker.

Hereinafter described are more details of the vacuum circuit breaker having the electrode 011 and the electrode 012.

As is seen in FIG. 11, there is provided a conceptual view of the vacuum circuit breaker having the electrode 011 and the electrode 012. The vacuum circuit breaker is constituted of a vacuum envelope 017, the electrode 011 and the electrode 012 as main component parts. The vacuum envelope 017 has an insulator tube 014 made of material such as ceramic, glass and the like. The insulator tube 014 has a first end (upper) sealed with an end plate 015 made of metal, and a second end (lower) sealed with an end plate 016 made of metal. With the thus sealed internal section, the vacuum envelope 017 is highly exhausted (vacuum). In the vacuum envelope 017, the electrode 011 is fixed to an end (lower in FIG. 11) of an immovable rod 018 while the electrode 012 is fixed to an end (upper in FIG. 11) of a movable rod 019. The electrode 011 and the electrode 012 are opposed to each other, and make a relative movement toward (contacting) and away (parting) from each other. With an inclination, an electric current I flows in the coil section 011*b* (of the electrode 011) and the coil section 012*b* (of the electrode 012), to thereby generate a longitudinal magnetic field B. With the thus generated longitudinal magnetic field B, the vacuum circuit breaker has a good breaking capability. In FIG. 11, also shown are a bellows 020 and an intermediate shield 021.

BRIEF SUMMARY OF THE INVENTION

It is, therefore, an object of the present invention to provide an electrode of a vacuum circuit breaker. The electrode under the present invention is the one that is shaped into a cup and has a longitudinal magnetic field, and that causes such a strong magnetic field as to feature a preferable breaking capability. Moreover, the electrode under the present invention is the one that features a sufficient mechanical strength even after repeated opening and closing operations (of a movable electrode and an immovable electrode).

It is another object of the present invention to provide a method of producing, with ease, the electrode of the vacuum circuit breaker featuring the preferable breaking capability and the sufficient mechanical strength, as described above.

According to a first aspect of the present invention, there is provided an electrode of a vacuum circuit breaker. The electrode comprises a cup member and a contact. The cup member has an opening and a periphery which is formed with a slit so as to form a coil section. An electric current flows in the coil section so as to generate a longitudinal magnetic field in a direction along an axis of the cup member. The slit is bent and continuously extends on the periphery from a first end of the cup member to a second end of the cup member opposite to the first end of the cup member. The contact is shaped into a plate, and seals the opening of the cup member.

According to a second aspect of the present invention, there is provided a method of producing an electrode of a vacuum circuit breaker. The electrode comprises a cup member having an opening which is sealed with a contact shaped into a plate. The cup member has a periphery which is formed with a slit so as to form a coil section. An electric current flows in the coil section so as to generate a longitudinal magnetic field in a direction along an axis of the cup member. The method comprises the following operations of: turning the cup member around the axis of the cup member by a predetermined rotational feed angle relative to a tool; and feeding the tool, in the direction along the axis of the cup member, relative to the cup member during the turning operation of the cup member, so as to form the slit which is bent and continuously extending on the periphery from a first end of the cup member to a second end of the cup member opposite to the first end of the cup member.

According to a third aspect of the present invention, there is provided a vacuum circuit breaker comprising a pair of a first electrode and a second electrode opposite to the first electrode. Each of the first electrode and the second electrode comprises a cup member and a contact. The cup member has an opening and a periphery which is formed with a slit so as to form a coil section. An electric current flows in the coil section so as to generate a longitudinal magnetic field in a direction along an axis of the cup member. The slit is bent and continuously extends on the periphery from a first end of the cup member to a second end of the cup member opposite to the first end of the cup member. The contact is shaped into a disk plate, and seals the opening of the cup member.

The other objects and features of the present invention will become understood from the following description with reference to the accompanying drawings.

DETAILED DESCRIPTION OF THE EMBODIMENT

Figure 1:
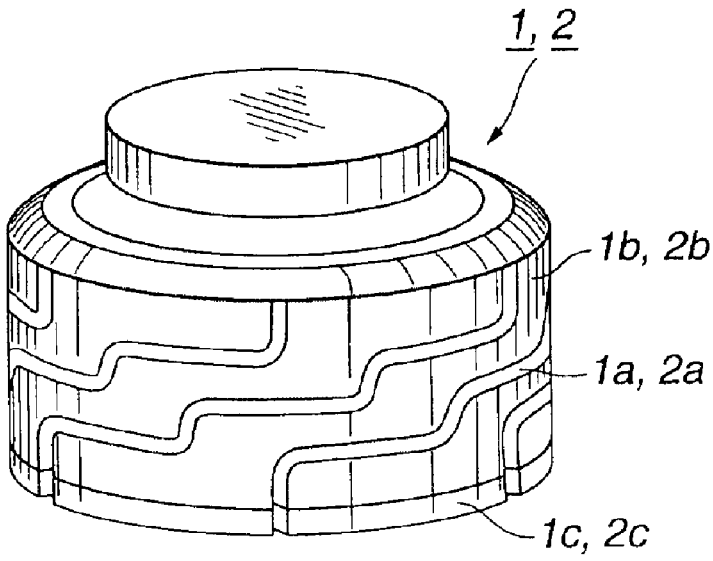
FIG. 1 is a perspective view of an electrode 1 (electrode 2), according to a first embodiment of the present invention.
Figure 2:
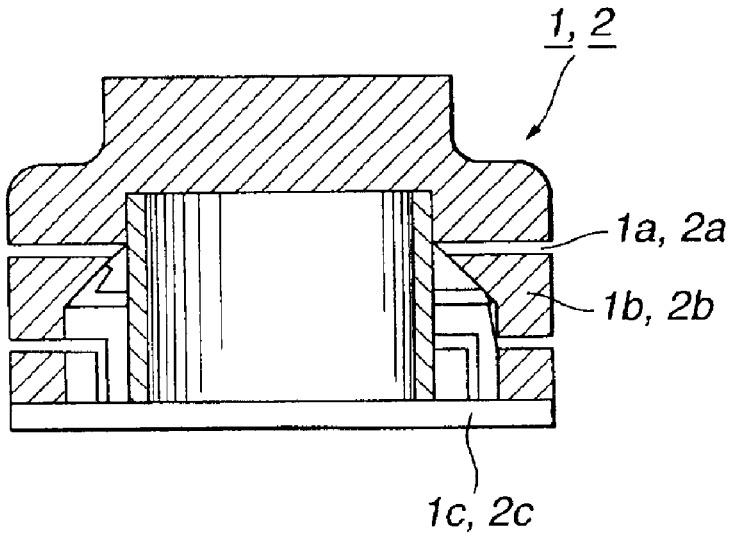
FIG. 2 is a cross sectional view of the electrode 1 (electrode 2) shown in FIG. 1.

As is seen in FIG. 1, there are provided an electrode 1 and an electrode 2, according to a first embodiment of the present invention.

Figure 11:
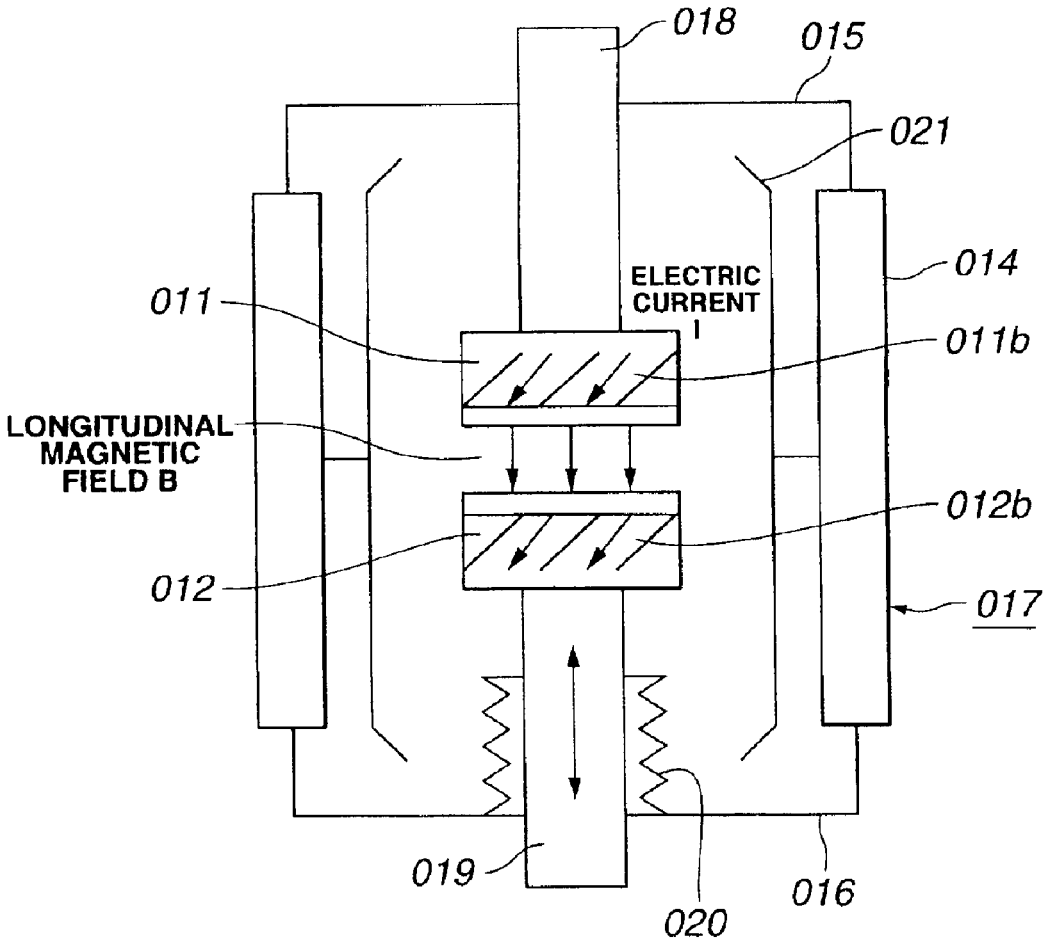
FIG. 11 is a schematic of a vacuum circuit breaker having the electrode 011 (electrode 012) shown in FIG. 8.

Like the electrode 011 and the electrode 012 in FIG. 11, the electrode 1 is fixed to the end (lower in FIG. 11) of the immovable rod 018 while the electrode 2 is fixed to the end (upper in FIG. 11) of the movable rod 019. The electrode 1 and the electrode 2 are opposed to each other, and make a relative movement toward (contacting) and away (parting) from each other. Moreover, the electrode 1 is constituted of a cup member and a contact 1*c* (shaped substantially into a disk) for sealing an opening of the cup member, while the electrode 2 is constituted of a cup member and a contact 2*c* (shaped substantially into a disk) for sealing an opening the cup member. The relative movement of the contact 1*c* and the contact 2*c* toward (contacting) and away (parting) from each other opens and closes the electric path.

According to the first embodiment, the cup member of the electrode 1 has a periphery which is formed with a slit 1*a* extending continuously and stepwise from a first end of the cup member to a second end of the cup member, while the cup member of the electrode 2 has a periphery which is formed with a slit 2*a* extending continuously and stepwise from a first end of the cup member to a second end of the cup member. Each of the slit 1*a* and the slit 2*a* is plural in number, to thereby form, respectively, a coil section 1*b* and a coil section 2*b*.

Figure 3:
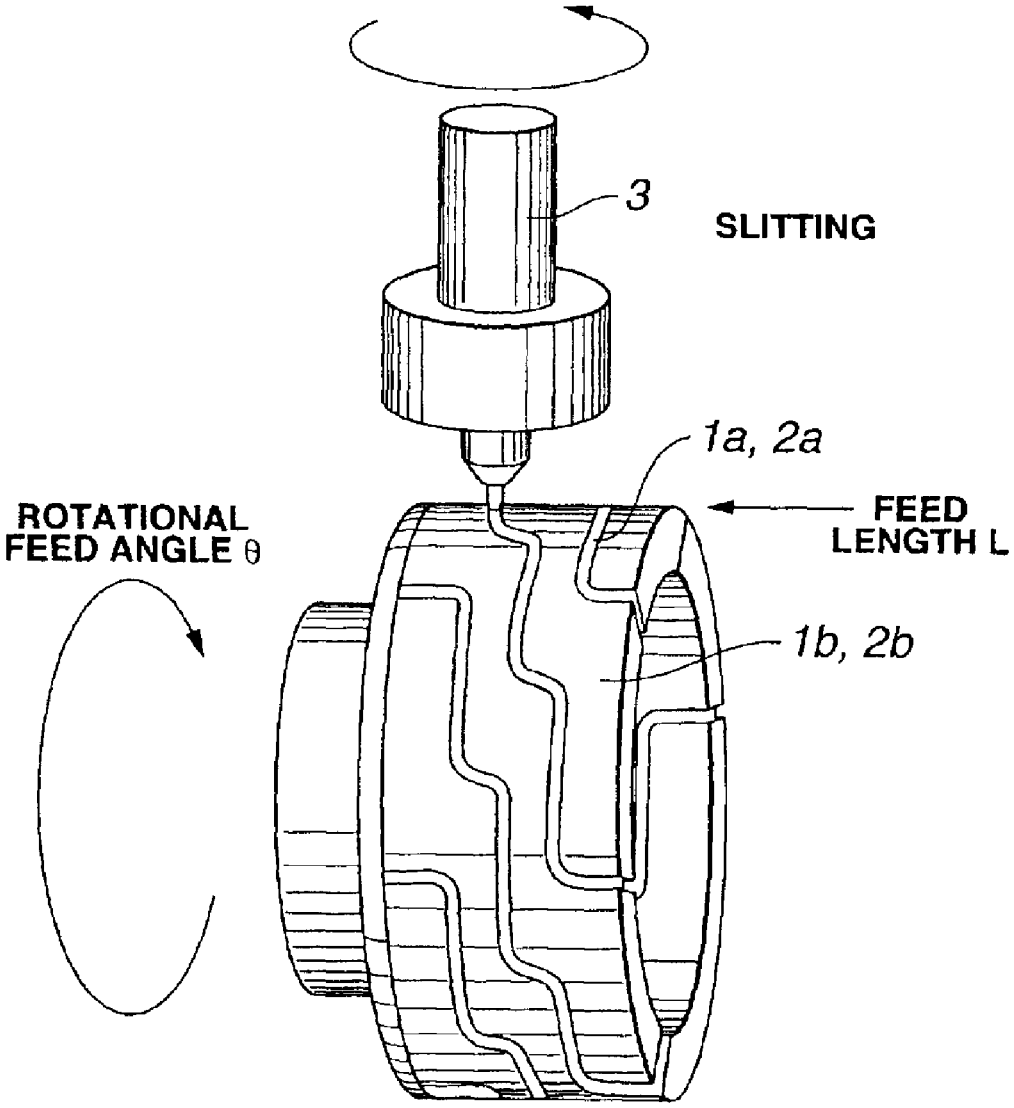
FIG. 3 is a perspective view of a method of producing the electrode 1 (electrode 2) in FIG. 1.

Hereinafter described referring to FIG. 3 is how to form the slit 1*a* and the slit 2*a*. The cup member is turned axially by a predetermined rotational feed angle θ. With a drill 3 (tool) being turned during the turning of the cup member, the cup member is fed axially by a feed length L. Herein, varying arbitrarily the rotational feed angle θ and the feed length L forms an arbitrarily bent slit. For forming the slit 1*a* and the slit 2*a* that are shaped stepwise, the above "turning" and "axial feeding" are carried out alternatively and intermittently. The drill 3 used as the tool can be replaced with a wire cut, a tip saw, a water jet and the like. The number of the plurality of the slits 1*a* and the slit 2*a* is not specifically limited.

Each of the slit 1*a* (of the electrode 1) and the slit 2*a* (of the electrode 2) according to the first embodiment is formed stepwise. Therefore, electric circuit has substantially a constant cross section. Moreover, in the vicinity of each of a first junction (between the coil section 1*b* and the contact 1*c*) and a second junction (between the coil section 2*b* and the contact 2*c*), a sufficient electric current flows toward an end face of the respective slit 1*a* and slit 2*a*.

Furthermore, an inclination (of each of the slit 1*a* and the slit 2*a*) relative to an axial line (of the cup member of each of the respective electrode 1 and electrode 2) is enlarged (Hereinafter, the inclination is referred to as "circumferential slit angle."). As a result, each of the slit 1*a* and the slit 2*a* is elongated circumferentially, to thereby secure sufficient longitudinal magnetic strength corresponding to breaking capability of breaking a required high voltage and large electric current.

Moreover, each of the slit 1*a* and the slit 2*a* is formed substantially perpendicular, respectively, to the contact 1*c* and the contact 2*c*, at the first and the second end thereof. The above perpendicularity contributes to reduction in stress concentration which is caused by a mechanical impact when the vacuum circuit breaker is input. Therefore, even repeated operations (opening and closing) of the vacuum circuit breaker are unlikely to cause failures such as peeling at the first junction (between the coil section 1*b* and the contact 1*c*) and the second junction (between the coil section 2*b* and the contact 2*c*).

Figure 4:
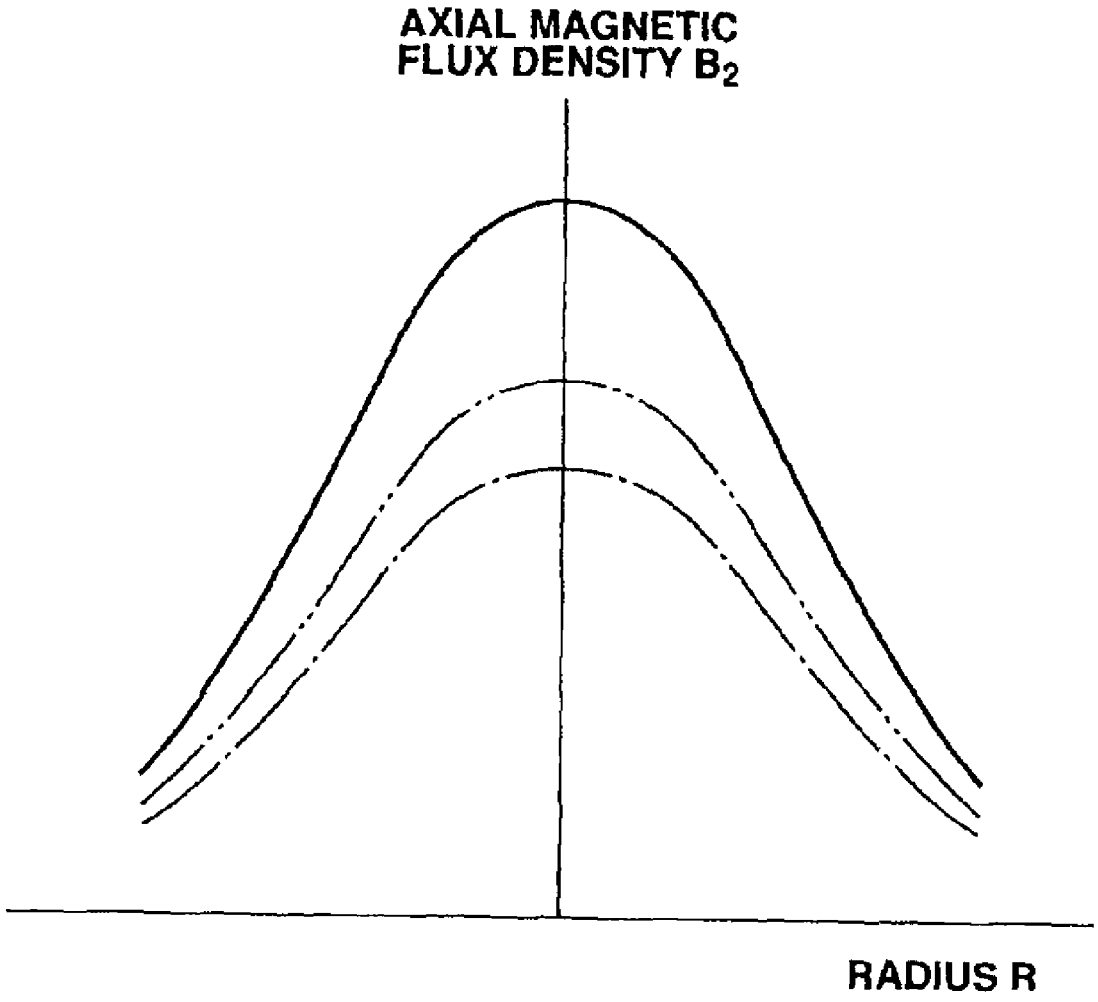
FIG. 4 is a radial distribution of a longitudinal magnetic element in a cross section at substantially the middle of the electrode 1 (electrode 2) according to the first embodiment, as compared with that of an electrode according to a related art.
Figure 8:
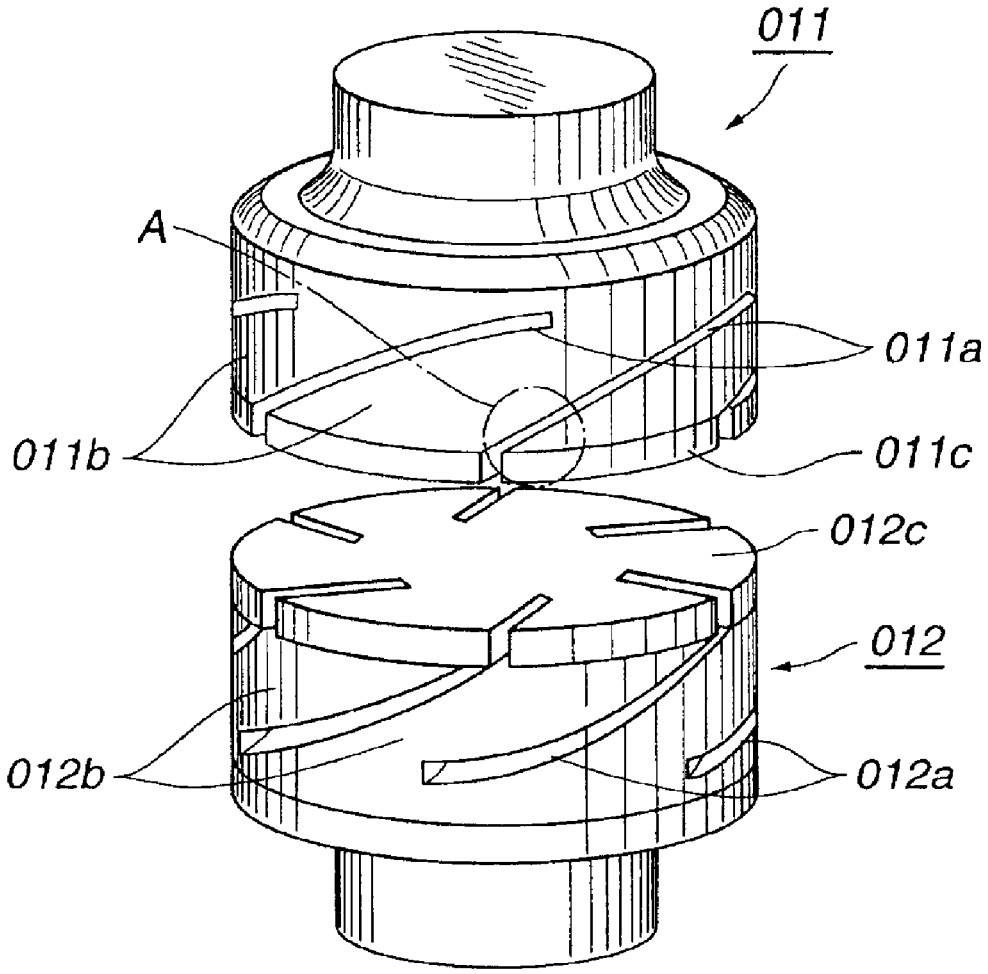
FIG. 8 is a perspective view of an electrode 011 (electrode 012), according to a second example of the related art.
Figure 9:
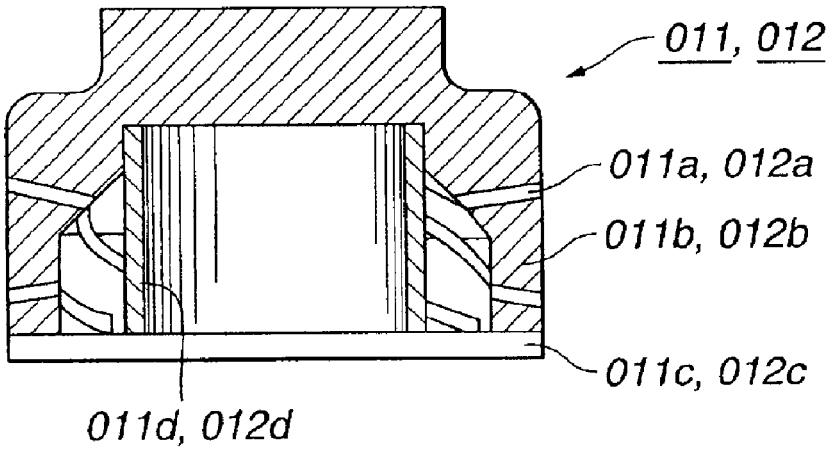
FIG. 9 is a longitudinal cross section of the electrode 011 (electrode 012) shown in FIG. 8.
Figure 10:
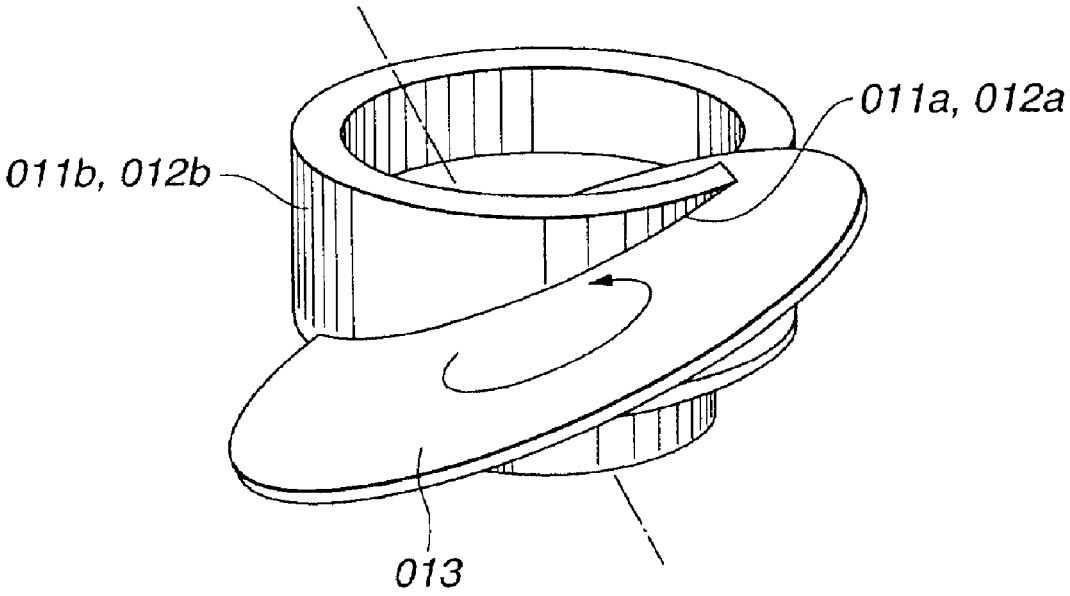
FIG. 10 is a perspective view of a method of producing the electrode 011 (electrode 012) shown in FIG. 8.

FIG. 4 shows a radial distribution of a longitudinal magnetic element in a cross section at substantially the middle of the electrode 1 (the electrode 2) according to the first embodiment of the present invention, as compared with that of the electrode 011 (the electrode 012) according to the related art in FIG. 8 to FIG. 10. The vertical axis in FIG. 4 is a magnetic flux density $B_2$ (T/A) per unit current, while the horizontal axis is a radius R of the electrode 1 (the electrode 2) and the electrode 011 (the electrode 012).

In FIG. 4, a one-dot chain curve (lower) shows a characteristic of the electrode 011 (the electrode 012) with the circumferential slit angle 120°, according to the related art.

In FIG. 4, a two-dot chain curve (middle) shows a characteristic of the electrode 1 (the electrode 2) with the circumferential slit angle 120°, according to the first embodiment of the present invention. Herein, the electrode 1 (the electrode 2) is the one that is formed with the stepwise slit 1*a* (the stepwise slit 2*a*).

In FIG. 4, a solid curve (upper) shows a characteristic of the electrode 1 (the electrode 2) with the circumferential slit angle 180°, according to the first embodiment of the present invention. Herein, the electrode 1 (the electrode 2) is the one that is formed with the stepwise slit 1*a* (the stepwise slit 2*a*) in FIG. 1.

As is seen in FIG. 4, even with the circumferential slit angle 120° (middle in FIG. 4), the electrode 1 (the electrode 2) according to the first embodiment shows the longitudinal magnetic field (magnetic flux density) stronger, by about 20%, than that of the electrode 011 (the electrode 012) according to the related art (lower in FIG. 4). With the circumferential slit angle 180° (upper in FIG. 4), the electrode 1 (the electrode 2) according to the first embodiment shows much stronger longitudinal magnetic field (magnetic flux density) than that of the electrode 011 (the electrode 012) according to the related art (lower in FIG. 4).

Although the present invention has been described above by reference to the first embodiment, the present invention is not limited to the first embodiment described above. Modifications and variations of the first embodiment described above will occur to those skilled in the art, in light of the above teachings.

More specifically, as seen in FIG. 1, each of the slit 1*a*(of the electrode 1) and the slit 2*a* (of the electrode 2) is formed stepwise. The configuration of each of the slit 1*a* and the slit 2*a*is, however, not limited to stepwise. Any other configuration is allowed provided that the features described in the following two sentences are met: 1. The inclination angles (relative to the axial line of the cup member of each of the electrode 1 and the electrode 2) are formed by a continuous curve that is a combination of plurality of different types of straight line segments. 2. The inclination is substantially perpendicular to a reverse face of each of the contact 1*c* and the contact 2*c*. The above two features are for enlarging the circumferential slit angle so as to elongate the coil section 1*b* and the coil section 2*b*, and for reducing the stress concentration at the first junction (between) the coil section 1*b* and the contact 1*c*) and the second junction (between the coil section 2*b* and the contact 2*c*.

Figure 5:
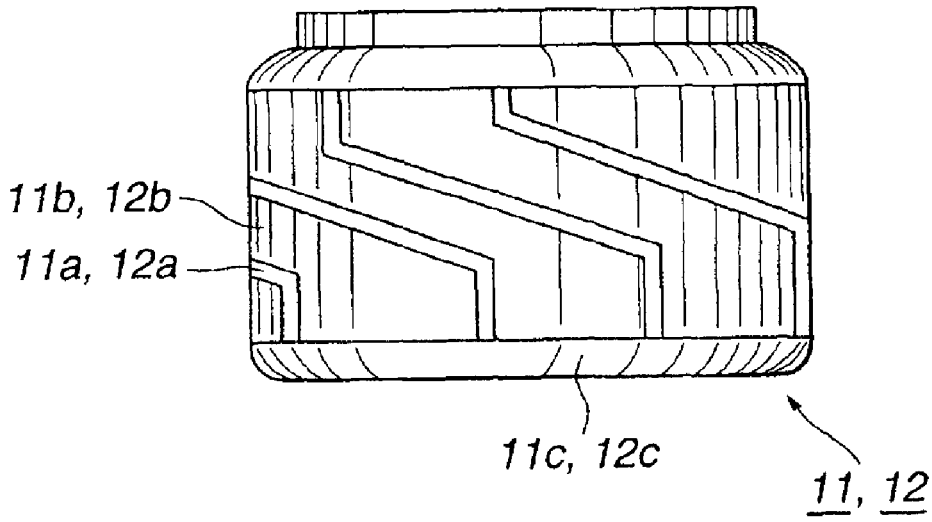
FIG. 5 is a front view of an electrode 11 (electrode 12), according to a second embodiment of the present invention.
Figure 6:
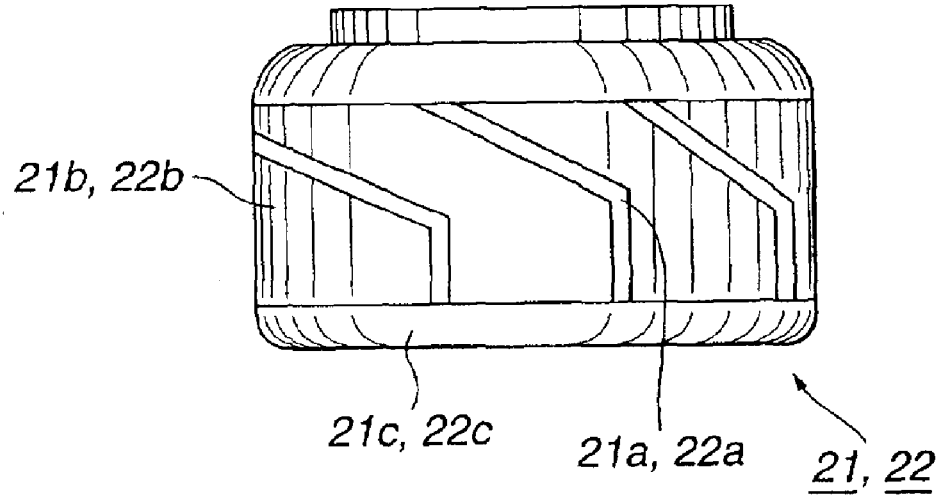
FIG. 6 is a front view of an electrode 21 (electrode 22), according to a third embodiment of the present invention.
Figure 7:
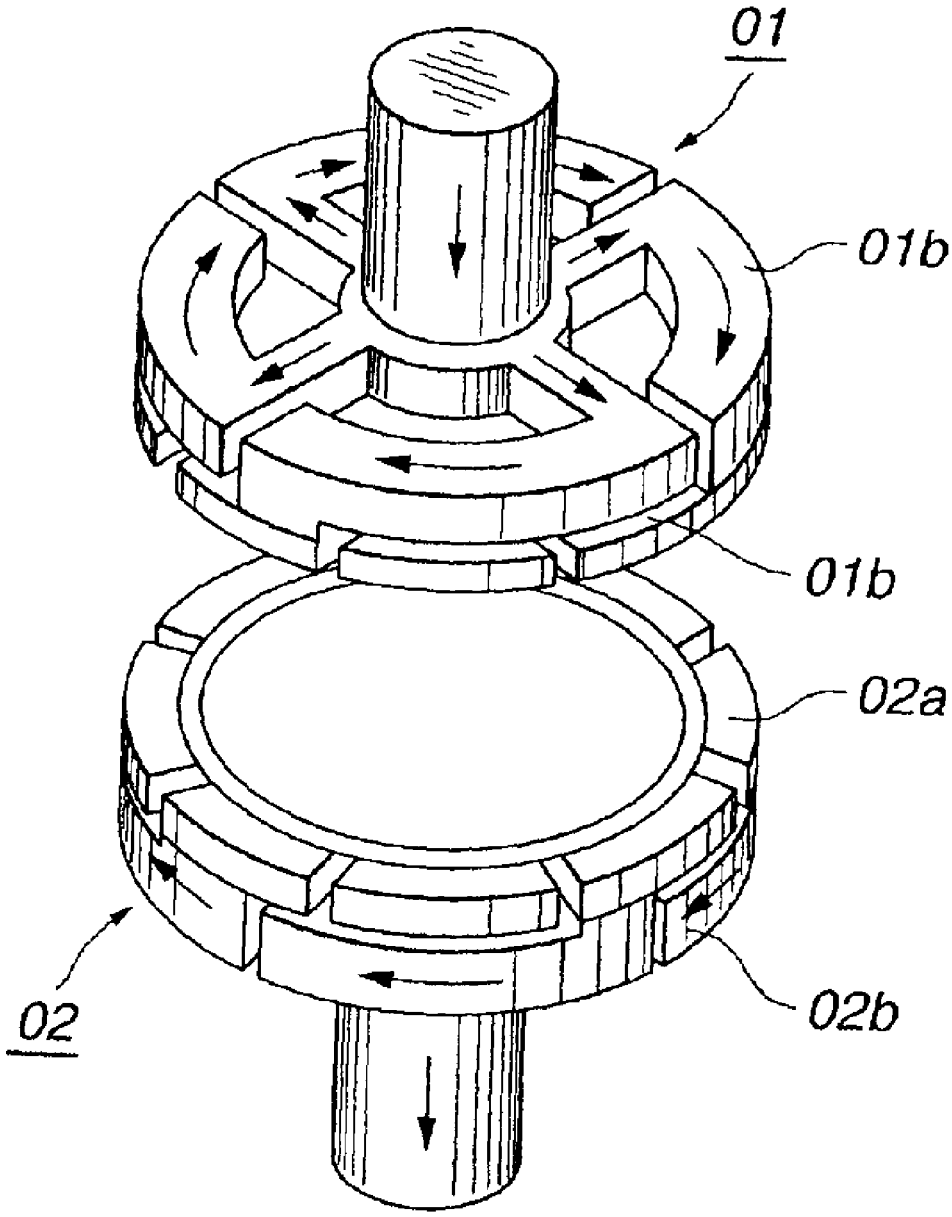
FIG. 7 is a perspective view of an electrode 01 (electrode 02), according to a first example of the related art.

Other allowable configurations are seen in FIG. 5 and FIG. 6.

As is seen in FIG. 5, there are provided an electrode 11 having a slit 11*a*, a coil section 11*b* and a contact 11*c*; and an electrode 12 having a slit 12*a*, a coil section 12*b*, and a contact 12*c*, according to a second embodiment of the present invention.

As is seen in FIG. 6, there are provided an electrode 21 having a slit 21*a*, a coil section 21*b*, and a contact 21*c*; and an electrode 22 having a slit 22*a*, a coil section 22*b*, and a contact 22*c*, according to a third embodiment of the present invention.

With the rotational feed angle θ and the feed length L controlled arbitrarily through the method shown in FIG. 3, each of the slit 11*a* (of the electrode 11), the slit 12*a* (of the electrode 12), the slit 21*a* (of the electrode 21) and the slit 22*a* (of the electrode 22) is formed.

The entire contents of basic Japanese Patent Application No. P2001-138213 (filed on May 9, 2001) of which priority is claimed is incorporated herein by reference.

The scope of the present invention is defined with reference to the following claims.

What is claimed is:

1. An electrode of a vacuum circuit breaker comprising:

a cup member having an opening and a periphery which is formed with a slit so as to form a coil section, an electric current flowing in the coil section so as to generate a longitudinal magnetic field in a direction along an axis of the cup member, the slit being bent and continuously extending on the periphery from a first end of the cup member to a second end of the cup member opposite to the first end of the cup member; and a contact shaped into a plate, and sealing the opening of the member wherein the bent slit comprises of:

a first line segment having a first end which is substantially perpendicular to a reverse face of the contact, the reverse face sealing the opening of the cup member, and a second line segment continuously connected to a second end of the first line segment opposite to the first end of the first line segment, the first line segment and the second line segment forming an inclination greater than a right angle, the second line segment being substantially parallel to the reverse face of the contact.

2. The electrode of the vacuum circuit breaker as claimed in claim 1, in which the bent slit is formed stepwise.

3. The electrode of the vacuum circuit breaker as claimed in claim 1, further comprising a plurality of the bent slits.

4. The electrode of the vacuum circuit breaker as claimed in claim 1, in which the contact is shaped substantially into a disk plate.

5. The electrode of the vacuum breaker as claimed in claim 2, wherein the inclination formed by the first line segment and the second line segment of the bent slit is substantially rounded.

6. The electrode of the vacuum circuit breaker as claimed in claim 3, further comprising five or more number of the bent slits.

* * * * *